US009222748B2

(12) United States Patent
Macy et al.

(10) Patent No.: US 9,222,748 B2
(45) Date of Patent: Dec. 29, 2015

(54) METHOD AND APPARATUS FOR LAUNCHING PROJECTILES USING A TOP MOUNTED STRIKER

(71) Applicants: Omar Alonso Macy, Gilroy, CA (US); Loc T. Pham, San Jose, CA (US)

(72) Inventors: Omar Alonso Macy, Gilroy, CA (US); Loc T. Pham, San Jose, CA (US)

(73) Assignee: Real Action Paintball, Inc. (RAP4), Gilroy, CA (US)

( * ) Notice: Subject to any disclaimer, the term of this patent is extended or adjusted under 35 U.S.C. 154(b) by 0 days.

(21) Appl. No.: 14/197,958

(22) Filed: Mar. 5, 2014

(65) Prior Publication Data

US 2015/0253102 A1 Sep. 10, 2015

(51) Int. Cl.
*F41B 11/62* (2013.01)
*F41B 11/643* (2013.01)

(52) U.S. Cl.
CPC ..... *F41B 11/643* (2013.01)

(58) Field of Classification Search
CPC ..... F41B 11/62; F41B 11/70; F41B 11/721; F41B 11/723; F41B 11/72
USPC ..... 124/71–77
See application file for complete search history.

(56) References Cited

U.S. PATENT DOCUMENTS

| | | | | |
|---|---|---|---|---|
| 6,561,176 | B1 * | 5/2003 | Fujimoto et al. | 124/76 |
| 7,210,473 | B2 * | 5/2007 | Jong | 124/73 |
| 7,624,726 | B2 * | 12/2009 | Wood | 124/73 |
| 8,671,927 | B1 * | 3/2014 | Macy | 124/73 |
| 8,683,990 | B2 * | 4/2014 | Macy | 124/73 |
| 8,899,219 | B2 * | 12/2014 | Macy | 124/73 |
| 2012/0060809 | A1 * | 3/2012 | Macy | 124/41.1 |
| 2012/0060814 | A1 * | 3/2012 | Macy | 124/73 |
| 2012/0325192 | A1 * | 12/2012 | Pham et al. | 124/73 |
| 2013/0047481 | A1 * | 2/2013 | Macy et al. | 42/49.01 |
| 2014/0060510 | A1 * | 3/2014 | Macy | 124/73 |
| 2014/0060511 | A1 * | 3/2014 | Macy | 124/73 |
| 2014/0060512 | A1 * | 3/2014 | Macy | 124/73 |
| 2014/0130787 | A1 * | 5/2014 | Macy | 124/73 |

* cited by examiner

*Primary Examiner* — Michael David
(74) *Attorney, Agent, or Firm* — Jamer M. Wu; JW Law Group

(57) ABSTRACT

A projectile launcher containing a top mounted striker launching mechanism capable of propelling a projectile or object is disclosed. In one aspect, the projectile launcher includes a bolt, a valve, and a striker. The bolt containing an air channel and a bolt carrier is situated inside a receiver of the projectile launcher. The bolt is used to facilitate launch of a projectile. The valve, which is situated inside the receiver above a firing chamber away from ground, is operable to control the release of pressurized gas for propelling the projectile. The striker, which is coupled to the bolt via the bolt carrier and is physically situated above the bolt away from the ground, is able to strike a valve pin of the valve to release a predefined amount of pressurized gas for propelling the projectile from the firing chamber to a target.

13 Claims, 11 Drawing Sheets

METHOD AND APPARATUS FOR LAUNCHING PROJECTILES USING A TOP MOUNTED STRIKER

FIELD

The present invention relates to projectile propelling systems or apparatus. More specifically, the present invention relates to arrangement of internal components associated with a projectile launcher.

BACKGROUND

New applications to use paintball guns or projectile launchers have become more popular in recent years. For example, paintball guns can be used in professional trainings, such as trainings for soldiers, policemen, security personals, and/or athletic participants. The success of training and/or competition may largely depend on how closely the paintball guns mimic and/or resemble the real firearms or semi-automatic hand guns.

A drawback associated with a conventional paintball gun or marker is that its internal construction is quite different from conventional firearms. For example, the physical construction and appearance of a conventional paintball gun are different from typical real firearms and/or guns partially because internal pressurized propelling system of a paintball gun which uses valve, striker, and bolt is different from a conventional gun. Accordingly, it is often difficult to replace the internal components of a real firearm with the internal components of a paintball gun.

SUMMARY

One embodiment of the present invention discloses a top mounted striker launching mechanism that is able to launch an object or projectile from the projectile launcher to a target. In one aspect, the projectile launcher includes a bolt, a valve, and a striker. The bolt containing an air channel and a bolt carrier is situated inside a receiver of the projectile launcher. The bolt is used to facilitate launch of a projectile. The valve, which is situated inside the receiver above the firing chamber away from ground, is operable to control the release of pressurized gas for propelling the projectile. The striker, which is coupled to the bolt via the bolt carrier and is physically situated above the bolt, is able to strike a valve pin of the valve to release a predefined amount of pressurized gas for propelling the projectile from the firing chamber to a target.

Additional features and benefits of the exemplary embodiment(s) of the present invention will become apparent from the detailed description, figures and claims set forth below.

BRIEF DESCRIPTION OF THE DRAWINGS

Exemplary embodiment(s) of the present invention will be understood more fully from the detailed description given below and from the accompanying drawings of various embodiments of the invention, which, however, should not be taken to limit the invention to the specific embodiments, but are for explanation and understanding only.

DETAILED DESCRIPTION

Figure 1:
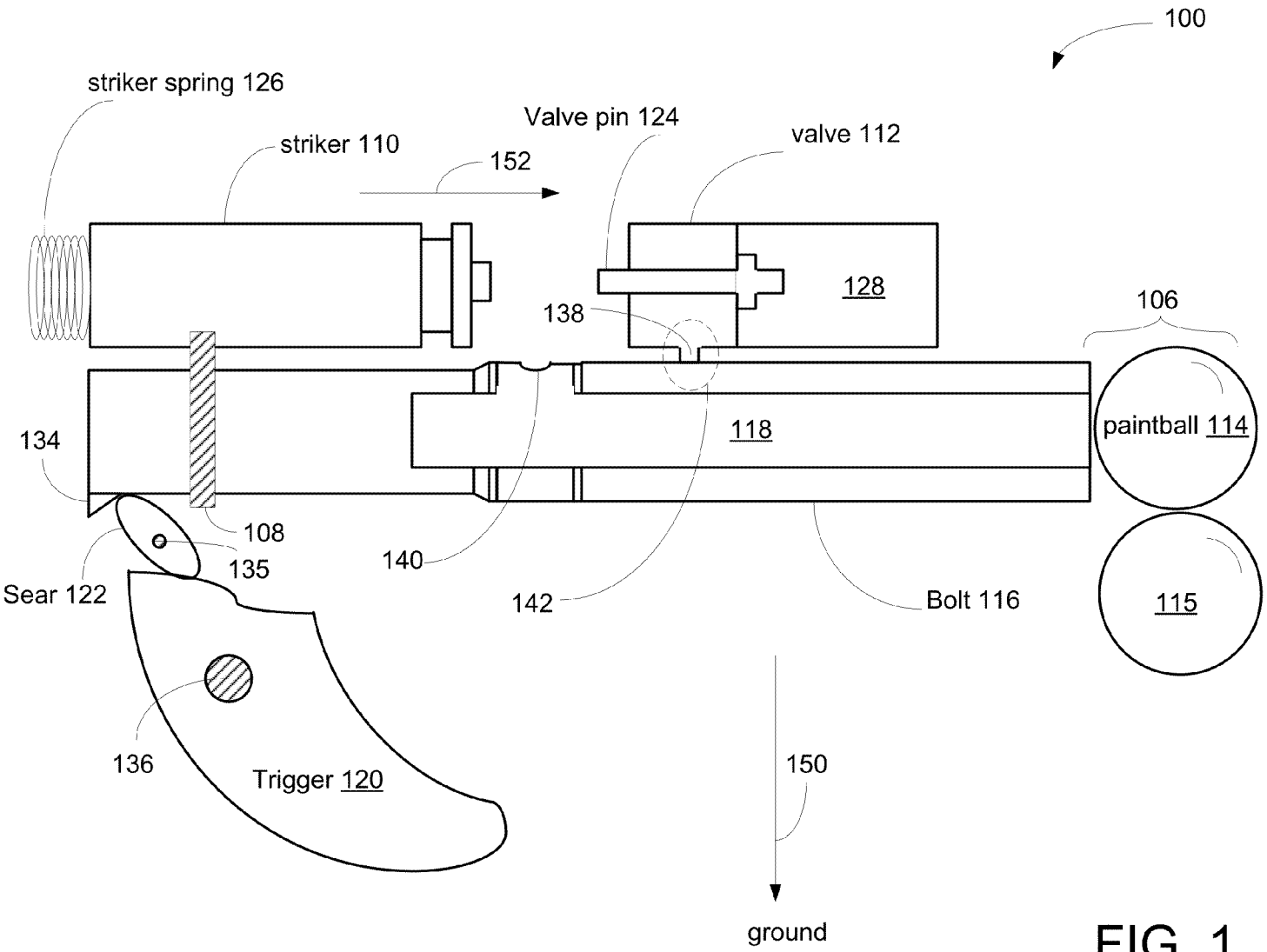
FIG. 1 is a block diagram illustrating a top mounted striker launching ("TSL") mechanism configured to be installed within a projectile launcher in accordance with one embodiment of the present invention.

Exemplary embodiment(s) of the present invention is described herein in the context of a method, system and apparatus of providing a paintball launcher using a top mounted striker to launch a projectile or object.

Those of ordinary skills in the art will realize that the following detailed description of the exemplary embodiment(s) is illustrative only and is not intended to be in any way limiting. Other embodiments will readily suggest themselves to such skilled persons having the benefit of this disclosure. Reference will now be made in detail to implementations of the exemplary embodiment(s) as illustrated in the accompanying drawings. The same reference indicators will be used throughout the drawings and the following detailed description to refer to the same or like parts.

References to "one embodiment," "an embodiment," "example embodiment," "various embodiments," "exemplary embodiment," "one aspect," "an aspect," "exemplary aspect," "various aspects," etc., indicate that the embodiment(s) of the invention so described may include a particular feature, structure, or characteristic, but not every embodiment necessarily includes the particular feature, structure, or characteristic. Further, repeated use of the phrase "in one embodiment" does not necessarily refer to the same embodiment, although it may.

In the interest of clarity, not all of the routine features of the implementations described herein are shown and described. It will, of course, be understood that in the development of any such actual implementation, numerous implementation-specific decisions may be made in order to achieve the developer's specific goals, such as compliance with application- and business-related constraints, and that these specific goals will vary from one implementation to another and from one developer to another. Moreover, it will be understood that such a development effort might be complex and time-consuming, but would nevertheless be a routine undertaking of engineering for those of ordinary skills in the art having the benefit of this disclosure.

Various embodiments of the present invention illustrated in the drawings may not be drawn to scale. Rather, the dimensions of the various features may be expanded or reduced for clarity. In addition, some of the drawings may be simplified for clarity. Thus, the drawings may not depict all of the components of a given apparatus (e.g., device) or method.

As used herein, the singular forms of article "a", "an" and "the" are intended to include the plural forms as well, unless the context clearly indicates otherwise. Also, the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. The term "and/or" includes any and all combinations of one or more of the associated listed items.

One embodiment of the present application discloses a top mounted striker launching mechanism placed inside a receiver of projectile launcher capable of propelling a projectile or object. The projectile launcher, in one aspect, includes a bolt, a valve, and a striker. The bolt containing an air channel and a bolt carrier is situated inside a receiver of the projectile launcher. The bolt is used to facilitate launch of a projectile. The valve, which is situated inside the receiver above a firing chamber away from ground, is operable to control the release of pressurized gas for propelling the projectile. The striker, which is coupled to the bolt via the bolt carrier and is physically situated above the bolt away from the ground, is able to strike a valve pin of the valve to release a predefined amount of pressurized gas for propelling the projectile from the firing chamber to a target.

FIG. 1 is a block diagram 100 illustrating a top mounted striker launching ("TSL") mechanism configured to be installed within a projectile launcher in accordance with one embodiment of the present invention. Diagram 100 includes a striker 110, a bolt 116, a valve 112, a triggering mechanism, and paintballs 114-115. The triggering mechanism further includes a trigger 120 and a sear 122. In one aspect, the TSL mechanism is installed inside a receiver of the projectile launcher wherein the projectile launcher can be non-lethal, less-lethal, or lethal firearm(s). It should be noted that the underlying concept of the exemplary embodiment(s) of the present invention would not change if one or more components (or units) were added to or removed from diagram 100.

Paintballs 114-115 are also known as objects, projectiles, balls, pellets, shells, slugs, vessels, capsules, and/or ammunition. The paintballs 114-115, for instance, can be non-lethal projectiles, less-lethal projectiles, and/or lethal projectiles. For example, non-lethal projectiles can be food-color based paintballs and lethal projectiles can be bullet or capsules that contain lethal substance such as chemical agents or poison. It should be noted that the terms "paintball," "projectiles," "objects," "non-lethal projectile," "less-lethal projectile," and "lethal projectile" will be used interchangeably herein.

Bolt 116 is situated inside a bolt chamber, not shown in FIG. 1, which allows bolt 116 to move or slide along the bolt chamber between a cocked position and a firing position. Bolt 116 includes an air channel 118, a bolt air inlet 140, and a bolt carrier 108. While air inlet 140 is able to receive a stream of pressurized air or gas, air channel 118 is configured to redirect or concentrate the stream of pressurized air for launching projectile(s). In one embodiment, bolt carrier 108 is used to affix or fasten striker 110 to bolt 116 so that their movements are synchronized. A function of bolt 116 is to push a paintball such as paintball 114 into a firing chamber, not shown in FIG. 1, and then release the stream of compressed or pressurized gas via air channel 118 to propel or launch paintball 114 from the firing chamber to its intended target.

In one embodiment, valve 112, which includes a valve pin 124, a valve outlet 138, and a pressure chamber 128, is configured to be placed on top of bolt 116 and/or firing chamber away from the ground as indicated by arrow 150. Depending on the applications, valve 112 can be either on top of bolt 118 or above the firing chamber away from the ground. Pressure chamber 128, in one example, is couple to a pressurized gas tank for providing pressurized gas supply. A flexible gas line may be used to connect pressure chamber 128 to the gas tank or gas source. The gas source may be a nitrogen tank, a carbon dioxide (CO2) canister, and/or a compressed air canister.

Valve pin 124 functions as a gate for releasing or gating certain amount of pressurized gas when valve pin 124 is stricken or pushed by a hammer or striker such as striker 110. Valve outlet 138 is configured to momentarily align with bolt air inlet 140 as indicated by numeral 142 which allows a passage of pressurized gas from valve 112 to air channel 118 during a launching process. The amount of pressurized gas released by valve 112 depends on the force generated by striker 110.

Striker 110 is situated inside a striker chamber, not shown in FIG. 1, which allows striker 110 to move or slide inside the striker chamber between a cocked position and a firing position. In one embodiment, striker 110 is placed on top of bolt 116 away from the ground or against gravity as indicated by arrow 150. Striker 110, in one example, is attached to bolt 116 by bolt carrier 108 whereby the movements between striker 110 and bolt 116 are synchronized. When striker 110 is set or cocked as shown in FIG. 1, striker 110 is held by bolt 116 and is pushed against striker spring 126. Upon release of sear 122, striker spring 126, in one example, generates a spring force pushing striker 110 toward valve 112 in a direction indicated by arrow 152.

A projectile launcher or paintball maker, in one aspect, includes a receiver, a triggering mechanism, a barrel assembly, and a buttstock, wherein the receiver includes the TSL mechanism. The TSL mechanism, in one embodiment, includes a bolt 116, valve 112, and a striker 110. Bolt 116, having air channel 118 and bolt carrier 108, facilitates a launch process by pushing the projectile such as paintball 114 from a loading chamber 106 to a firing chamber and then propelling the projectile from the firing chamber to a target using pressurized gas.

Valve 112, in one embodiment, is situated inside the receiver above a firing chamber away from ground as indicated by arrow 150. A function of valve 112 is to control the release of pressurized gas for propelling the projectile. Striker 110, in one embodiment, is physically situated above bolt 116 and is configured to strike valve pin 124 of valve 112 to release a predefined amount of pressurized gas for propelling the projectile such as paintball 114.

The triggering mechanism, in one example, includes sear 122 and trigger 120, wherein sear 122 pivots around sear center 135 and trigger 120 pivots around trigger center 136 when trigger 120 is pulled. Sear 122 is situated adjacent to bolt 116 and configured to control the movement of bolt 116 when one end of sear 122 catches bolt stopper 134 of bolt 116. Sear 122 releases bolt stopper 134 when trigger 120 is pulled by a user. Note that the bolt chamber facilitates the movement of bolt 116 and the striker chamber facilitates the movement of striker 110. In one embodiment, the bolt chamber is situated underneath the striker chamber closer to the ground as indicated by arrow 150. It should be noted that the movement of bolt 116 and the movement of striker 110 in the receiver are substantially synchronized by bolt carrier 108.

The projectile launcher also includes an ammunition magazine which contains or houses projectiles or paintballs. The ammunition magazine or clip, not shown in FIG. 1, is able to couple to a loading port of the receiver for supplying ammunition such as paintball 115. In one embodiment, the ammunition magazine is situated below bolt 116 closer to the ground as indicated by arrow 150. The triggering mechanism, in one example, is located at the bottom side of receiver adjacent to the ammunition magazine. When a user pulls trigger 120, the triggering mechanism initiates a projectile firing process.

Referring back to FIG. 1, diagram 100 illustrates a cocked position of striker 110 within the TSL mechanism. Striker 110, in this example, is fully cocked against striker spring 126 which is also known as rear stopper, and it is held by bolt carrier 108. Bolt carrier 108 affixes striker 110 to bolt 116. Bolt stopper 134 of bolt 116 is held by sear 122 which maintains bolt 116 current position. Trigger 120 is used to prevent any movement of sear 122 until trigger 120 is pulled by a user. When bolt 116 is in the cocked position, paintball 114 moves from a magazine, not shown in FIG. 1, to loading chamber 106. Note that paintball 115 is ready to move into loading chamber 106 as soon as paintball 114 is launched.

An advantage of using the TSL mechanism is that a projectile launcher using a top mounted striker looks like a real firearm. The top mounted striker and/or top mounted valve makes easier for projectiles to move from the magazine to loaning chamber 106. Also, with top mounted striker, it may provide additional pressurized gas to the valve.

Another advantage is that with a top mounted striker of TSL mechanism, the TSL mechanism can be configured more easily to fit inside a receiver of a real gun. For example, the TSL mechanism allows a user to move trigger 120 with seven (7) degrees to initiate a firing, which mimics a real gun.

Figure 2:
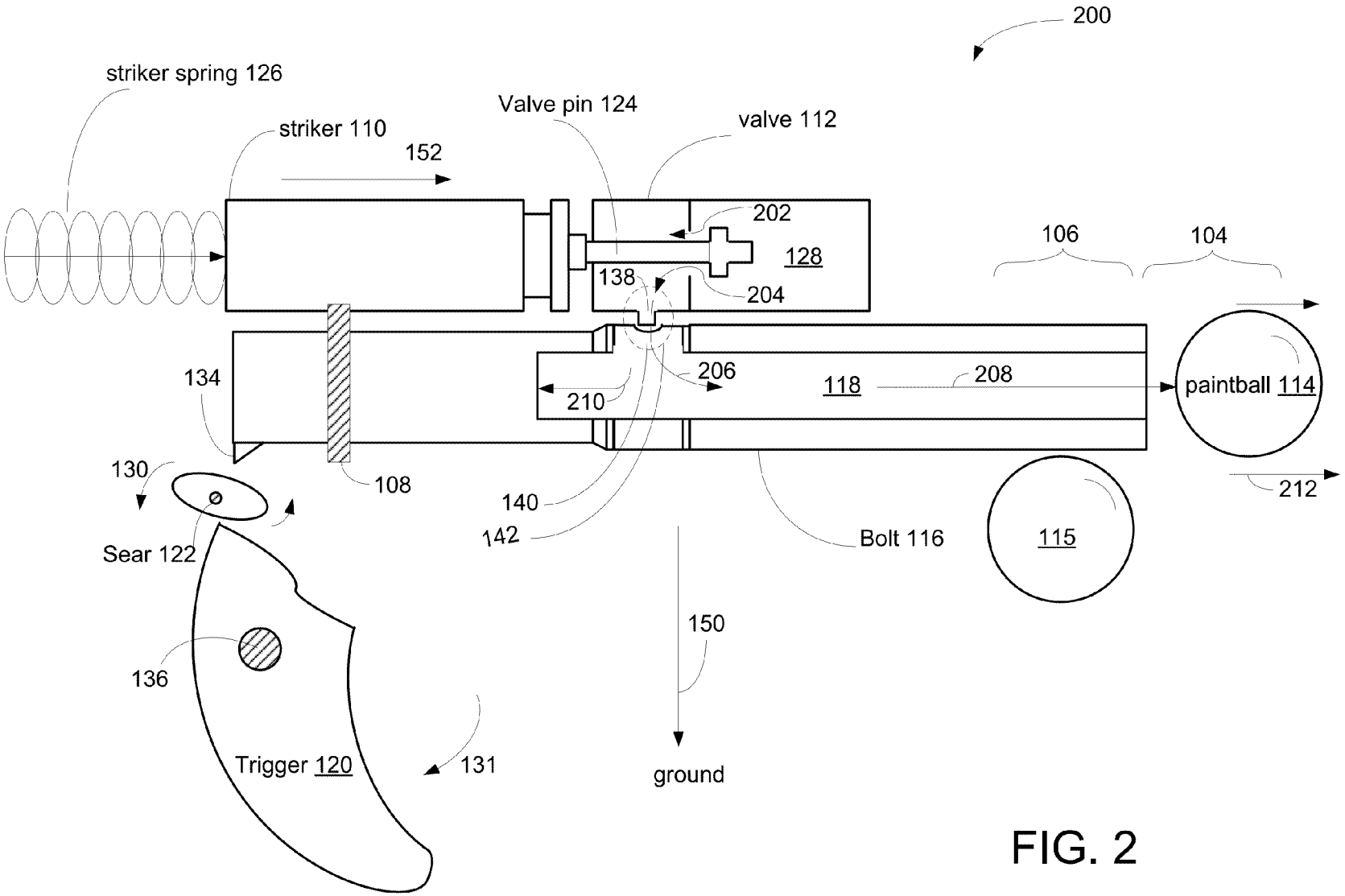
FIG. 2 is a block diagram illustrating a TSL mechanism used in a projectile launcher capable of propelling the projectile in accordance with one embodiment of the present invention.

FIG. 2 is a block diagram 200 illustrating a TSL mechanism used in a projectile launcher capable of propelling a projectile in accordance with one embodiment of the present invention. Diagram 200 is similar to diagram 100 shown in FIG. 1 except that diagram 100 illustrates the TSL mechanism in a position of "ready for firing" or cocked scenario while diagram 200 illustrates the TSL mechanism in a firing scenario. Diagram 200, like diagram 100, includes a striker 110, a bolt 116, a valve 112, a triggering mechanism, and paintballs 114-115. In one aspect, striker 110 and valve 112 are physically situated above bolt 116 away from the ground as indicated by arrow 150. It should be noted that the underlying concept of the exemplary embodiment(s) of the present invention would not change if one or more components (or units) were added to or removed from diagram 200.

As illustrated in diagram 200, after pulling trigger 120 by a user as indicated by arrow 131, trigger 120 pivots around trigger center 136 which initiates a pivoting motion of sear 122 as indicated by arrow 130. Upon releasing bolt stopper 134 as sear 122 pivots, striker spring 126 generates sufficient force to push striker 110 in a direction indicated by arrow 152. Since striker 110 is fastened to bolt 116 via bolt carrier 108, bolt 116 also moves in a direction as indicated by arrow 152 whereby paintball 114 is pushed by bolt 116 from loading chamber 106 to firing chamber 104. At the substantially same moment, bolt inlet 140 is aligned with valve outlet 138 as indicated by numeral 142 when bolt 116 moves into a firing position.

Valve pin 124 is stricken or pushed as striker 110 moves rapidly in the direction indicated by arrow 152 due to the force generated by striker spring 126. When striker 110 strikes valve pin 124, valve pin 124 releases a predefined amount of pressurized gas 202-204 from pressure chamber 128 and allows pressurized gas 202-204 to flow into air channel 118 via valve outlet 138 and bolt inlet 140. After the stream of pressurized gas moves into air channel 118, a portion of pressurized gas 206 becomes a firing force 208 for launching paintball 114. A second portion of pressurized gas 210 together with residual pressurized gas 206 becomes recoil force or cocking force. After paintball 114 is fired or launched from firing chamber 104 in a direction indicated by arrow 212, bolt 116 recoils in response to pressurized gas 210 which cocks striker 110 to a position ready for firing as shown in FIG. 1.

During an operation, an operator or user pulls trigger 120 and a chain of firing sequence follows. The operator can continuously pull trigger 120 which will render continuously firing of projectiles until the ammunition runs out. An advantage for employing TSL mechanism with an open bolt position as shown in FIG. 1 is that it reduces complexity to replace the TSL mechanism with internal components of a real firearm.

Figure 3:
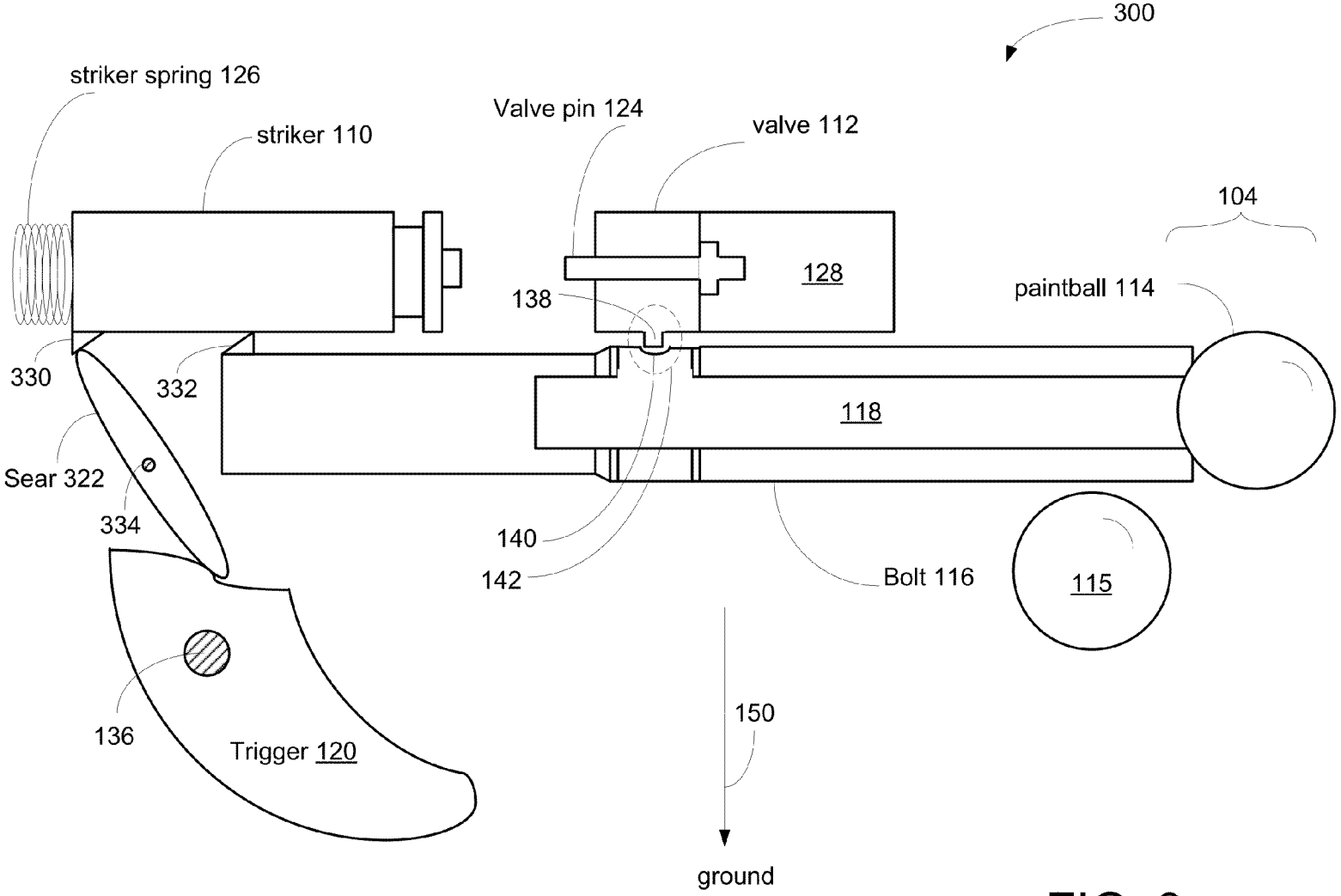
FIG. 3 is a block diagram illustrating a closed scenario of TSL mechanism using a releasable bolt carrier in accordance with one embodiment of the present invention.

FIG. 3 is a block diagram 300 illustrating a closed scenario of TSL mechanism using a releasable bolt carrier in accordance with one embodiment of the present invention. Diagram 300 is similar to diagram 100 shown in FIG. 1 except that diagram 100 illustrates a fixed bolt carrier 108 while diagram 300 illustrates a releasable bolt carrier 332 used in the TSL mechanism. Diagram 300, like diagram 100, includes a striker 110, a bolt 116, a valve 112, a triggering mechanism, and paintballs 114-115. In one aspect, striker 110 and valve 112 are physically situated above bolt 116 away from the ground as indicated by arrow 150. It should be noted that the underlying concept of the exemplary embodiment(s) of the present invention would not change if one or more components (or units) were added to or removed from diagram 300.

Diagram 300 illustrates a closed scenario of TSL mechanism wherein releasable bolt carrier 332 of bolt 116 disconnects from striker 110 after striker 110 is cocked or is in a position ready for firing. As bolt 116 slides away from a cocked or recoiled striker 110, bolts 116 pushes paintball or projectile 114 from the loading chamber to firing chamber 104. A closed scenario of TSL mechanism is accomplished when bolt 116 stops after paintball 114 is loaded into firing chamber 104. In one example, valve outlet 138 and bolt inlet 140 are aligned as indicated by numeral 142.

Striker 110, in one aspect, is held by sear 322 wherein one end of sear 322 catches striker stopper 330 and second end of sear 322 is maintained by trigger 120. It should be noted that sear 322 is configured to link between striker 110 and trigger 120 across the bolt chamber. Note that bolt chamber facilitates movement of bolt between cocking, closed, and/or firing position. It should be noted that releasable bolt carrier 332 can be any types of bolt hook as long as the bolt carrier catches striker 110 during the cocking process and subsequently, releases striker 110 when it is cocked.

A projectile launcher, in one aspect, includes a TSL mechanism, an ammunition magazine, and a triggering element. The TSL mechanism, in one example, includes bolt 116, striker 110, and valve 112. Bolt 116, including air channel 118 and a releasable bolt carrier 332, is configured to be placed inside a receiver. Bolt 116 is able to facilitate propelling a projectile from a firing chamber. Valve 112 is also placed inside the receiver and situated above the firing chamber away from ground. Striker 110, which is releasably attached to the bolt via the releasable bolt carrier, is able to move in synch with bolt 116 during bolt recoiling. Striker 110 separates from bolt 116 after striker 110 is cocked.

During the launching of a projectile, striker 110 strikes a valve pin 124 of valve 112 to release a predefined amount of pressurized gas for propelling the projectile away from the projectile launcher. Striker 110, in one embodiment, is placed above bolt 116 and is situated further away from the bottom of receiver than the bolt. The triggering element, in one example, includes a sear 322 and trigger 120 wherein sear 322 is situated adjacent to bolt 116 and configured to control movement of striker 110 in response to movement of trigger 120.

In one example, the receiver includes a bolt chamber facilitating movement of bolt 116 and a striker chamber facilitating movement of striker 110. The striker chamber is located on top of the bolt chamber. Bolt 116 is able to reposition itself to a closed position adjacent to the firing chamber after disconnecting from striker 110.

A launcher or paintball maker which uses the TSL mechanism further includes an ammunition magazine that contains projectiles. The ammunition magazine is able to couple to a loading port of the receiver for supplying ammunition. In one example, the ammunition magazine is situated below bolt 116 and is situated closer to the ground than the bolt as indicated by arrow 150.

The triggering mechanism or element that is attached to bottom portion of the receiver is configured to use sear 322 for triggering the bolt. Note that bolt 116 includes a hammer or striker reset element able to reset striker 110 to a position ready for firing. It should be noted that bolt carrier 332 and striker stopper 330 are configured in such a way that bolt carrier 330 detaches from striker 110 when bolt 116 moves to a closed position ready for the next launch.

An advantage of using a datable or releasable bolt carrier 332 is that bolt 116 and projectile 114 are moved closer to a firing position whereby it can improve launch process with enhanced accuracy and distance.

Figure 4:
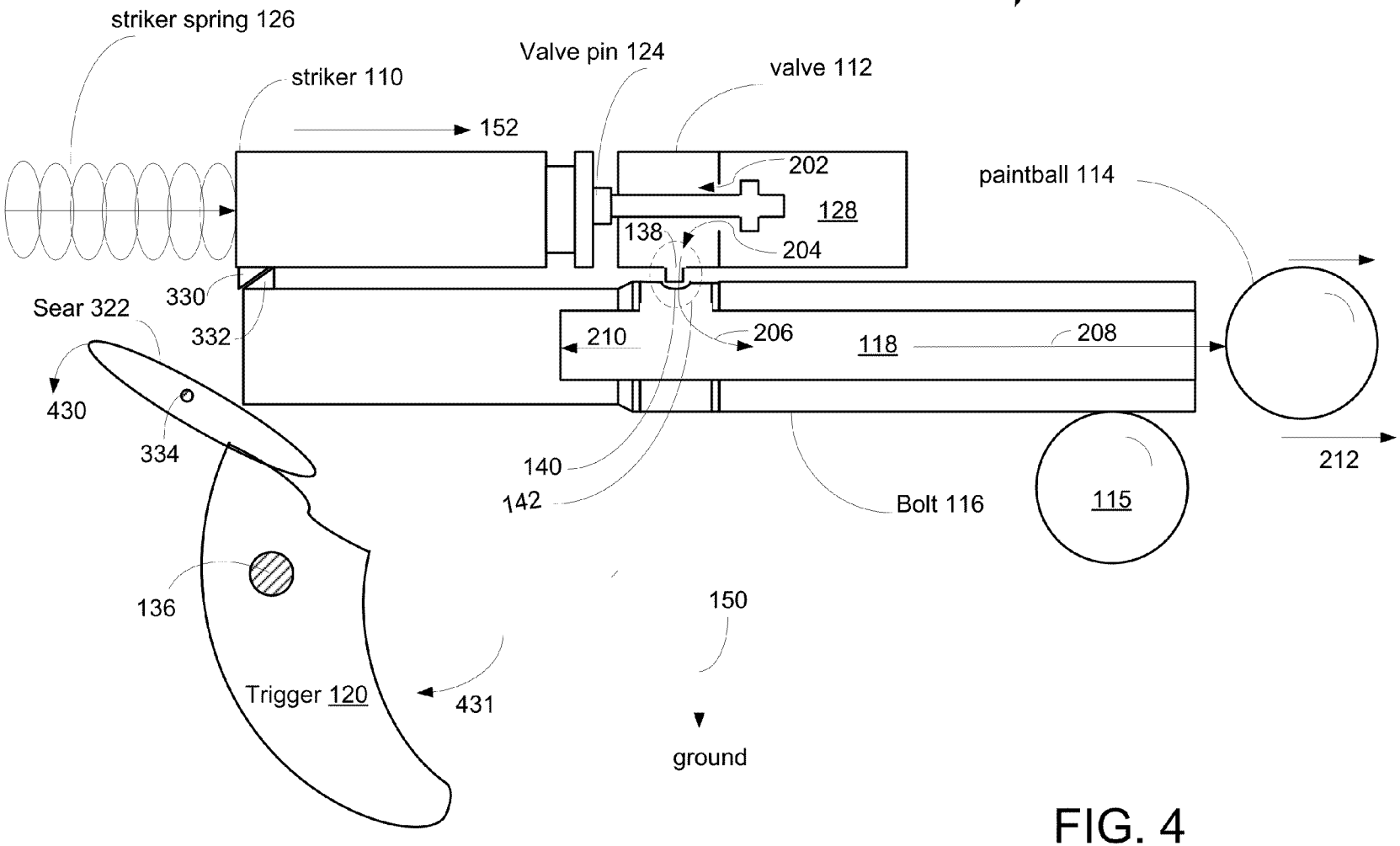
FIG. 4 is a block diagram illustrating a firing scenario in which the striker strikes the valve to propel the projectile from the firing chamber in accordance with one embodiment of the present invention.

FIG. 4 is a block diagram 400 illustrating a firing scenario in which the striker strikes the valve to propel the projectile from the firing chamber in accordance with one embodiment of the present invention. Diagram 400 is similar to diagram 300 shown in FIG. 3 except that diagram 300 illustrates the TSL mechanism in a position "ready for firing" or cocked scenario while diagram 400 illustrates the TSL mechanism in a firing scenario. Diagram 400, like diagram 300, includes a striker 110, a bolt 116, a valve 112, a triggering mechanism, and paintballs 114-115. In one aspect, striker 110 and valve 112 are physically situated above bolt 116 away from the ground as indicated by arrow 150.

As illustrated in diagram 400, after pulling trigger 120 by a user as indicated by arrow 431, trigger 120 pivots around trigger center 136 which initiates a pivoting motion of sear 322 as indicated by arrow 430. Upon releasing striker stopper 330 as sear 322 pivots, striker spring 126 generates sufficient spring force to push striker 110 in a direction indicated by arrow 152. Since striker 110 is independent from bolt 116, bolt 116 stations in the same location next to the firing chamber. At the substantially same moment, bolt inlet 140 is aligned with valve outlet 138 as indicated by numeral 142.

Valve pin 124 is stricken or pushed as striker 110 moves rapidly in the direction indicated by arrow 152 due to the force generated by striker spring 126. When striker 110 strikes valve pin 124, valve pin 124 releases a predefined amount of pressurized gas 202-204 from pressure chamber 128 and allows pressurized gas 202-204 to flow into air channel 118 via valve outlet 138 and bolt inlet 140. After the stream of pressurized gas moves into air channel 118, a portion of pressurized gas 206 becomes a firing force 208 for launching paintball 114. A second portion of pressurized gas 210 together with residual pressurized gas 206 becomes recoil force or cocking force. After paintball 114 is fired or launched from firing chamber 104 in a direction indicated by arrow 212, bolt 116 recoils in response to pressurized gas 210 which cocks striker 110.

Figure 5:
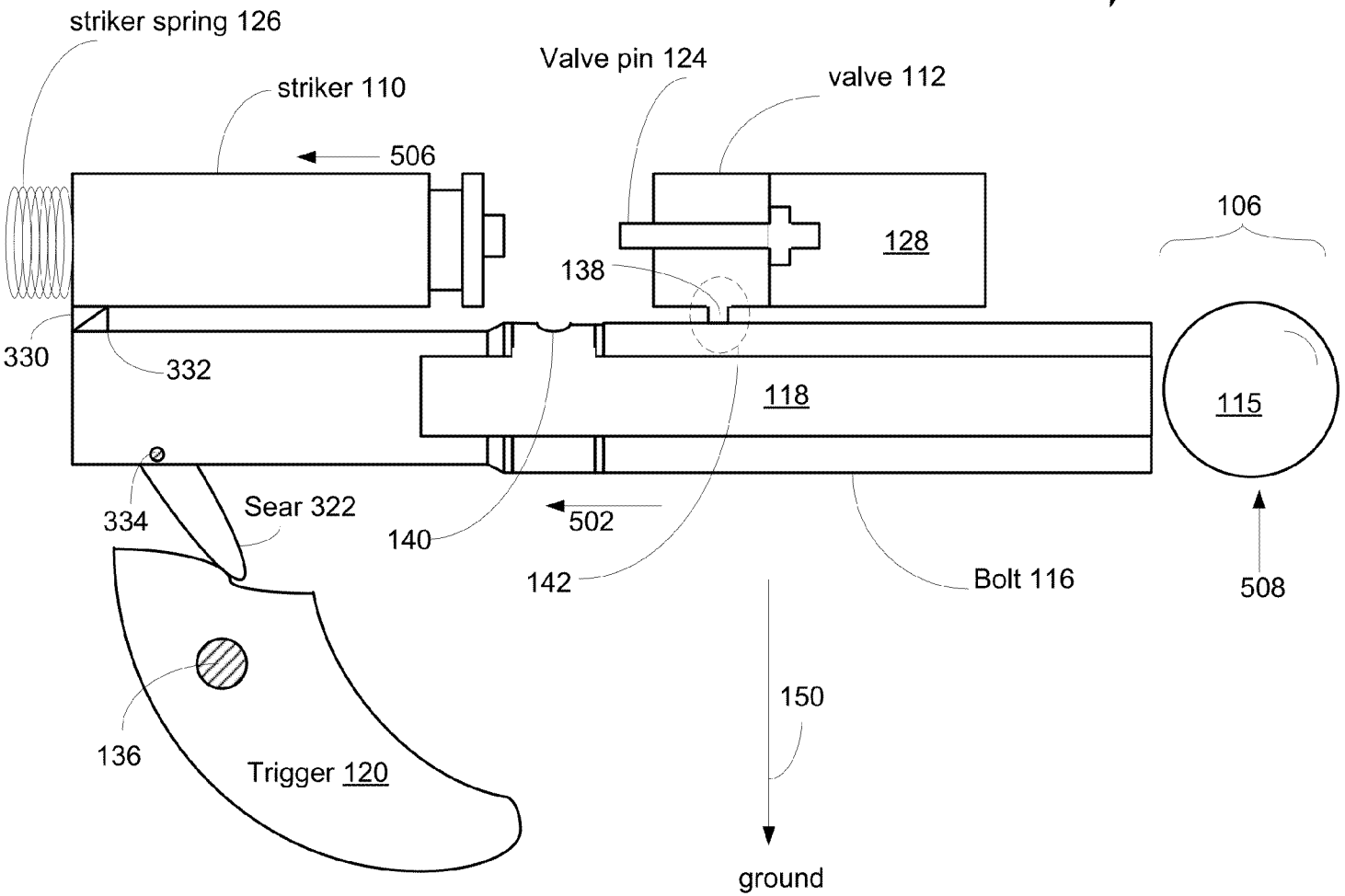
FIG. 5 is a block diagram illustrating a cocking scenario wherein the striker is cocked immediately after firing in accordance with one embodiment of the present invention.

FIG. 5 is a block diagram 500 illustrating a cocking scenario wherein the striker is cocked immediately after firing in accordance with one embodiment of the present invention. Diagram 500 is similar to diagram 400 shown in FIG. 4 except that diagram 400 illustrates the TSL mechanism in a firing scenario while diagram 500 illustrates the TSL mechanism in a cocking or recoiling scenario. Diagram 500, like diagram 400, includes a striker 110, a bolt 116, a valve 112, a triggering mechanism, and paintballs 114-115. In one aspect, striker 110 and valve 112 are physically situated above bolt 116 away from the ground as indicated by arrow 150.

The recoiling or cocking force generated during the projectile launching, bolt 116 moves in a direction indicated by arrow 502 which is an opposite direction as the travel direction of the launched projectile. As bolt 116 moves, detachable or releasable bolt carrier 332 catches striker stopper 330 whereby striker 110 moves in the same direction as bolt 116 as indicated by arrow 506. As bolt 116 moves, projectile 115 moves from a loading port of receiver or magazine into loading chamber 106 as indicated by arrow 508. It should be noted that when striker 110 is cocked to a position ready for firing, detachable bolt carrier 332 releases striker stopper 330 and allows bolt 116 to move away from striker 110 and pushing projectile 115 into the firing chamber.

Figure 6A:
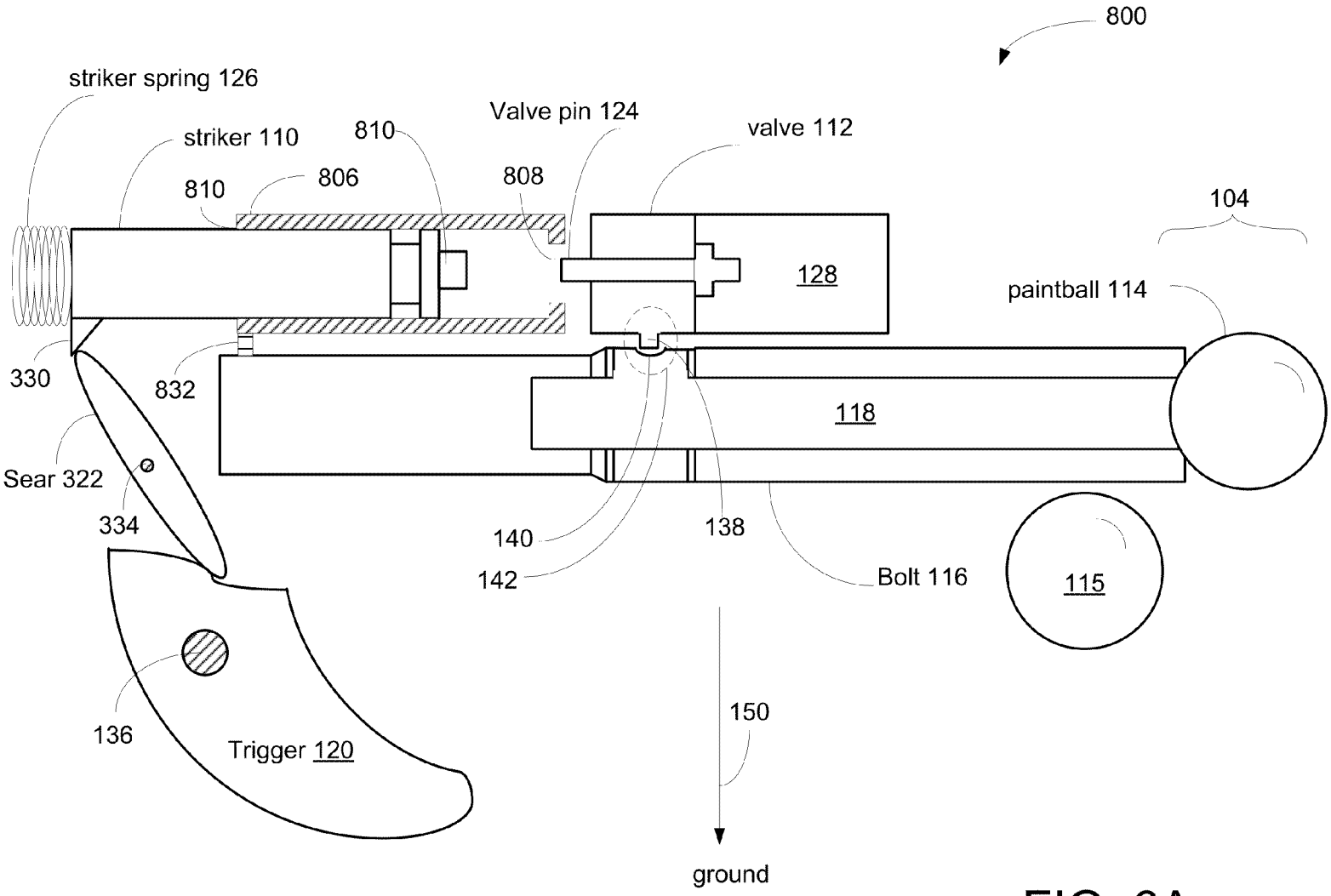
FIGS. 6A-C are exemplary diagrams illustrating firing and closed scenarios of TSL mechanism using a piston in accordance with one embodiment of the present invention.

FIG. 6A is a block diagram 800 illustrating a closed scenario of TSL mechanism using a piston or sleeve 806 in accordance with one embodiment of the present invention. Diagram 800 is similar to diagram 300 shown in FIG. 3 except that diagram 800 includes a piston 806 which is used to align or place bolt 116 to a closed or a ready to fire or a battery position. Diagram 800 includes a piston 806, a striker 110, a bolt 116, a valve 112, a triggering mechanism, and paintballs 114-115. In one aspect, striker 110 and valve 112 are physically situated above bolt 116 away from the ground as indicated by arrow 150. It should be noted that the underlying concept of the exemplary embodiment(s) of the present invention would not change if one or more components (or units) were added to or removed from diagram 300.

Piston 806, in one embodiment, is a cylindrical shaped sleeve having a first opening 810 and a second opening 808. Opening 810 is configured to have a diameter that similar or slightly larger than the diameter of striker 110 whereby allowing striker 110 to slide inside piston 806. Opening 808 is configured to have a diameter greater than the diameter of striking header 810 of striker 110 whereby allowing striking header 810 to pass through opening 808 and to strike valve pin 124 during the firing. Piston 806 further includes a piston anchor 832 used to fasten piston to bolt 116.

An advantage of using a piston 806 is that bolt 116 and projectile 114 are moved closer to a firing position whereby it can improve launch process with enhanced accuracy and distance.

Figure 6B:
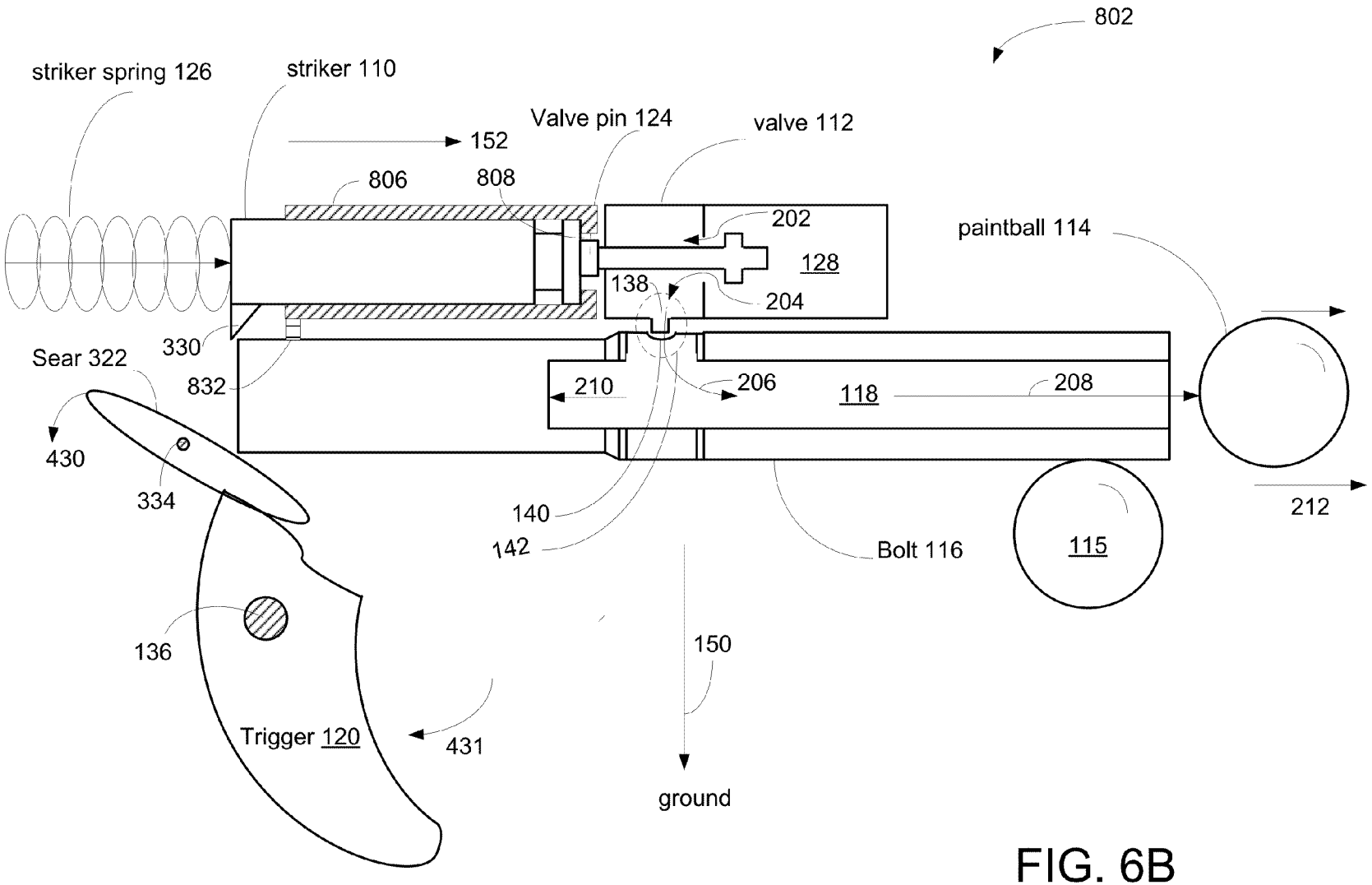

FIG. 6B is a block diagram 802 illustrating a firing scenario in which the striker strikes the valve to propel the projectile from the firing chamber in accordance with one embodiment of the present invention. Diagram 802 is similar to diagram 400 shown in FIG. 4 except that diagram 802 includes a piston 806. During the firing, striker 110 strikes valve pin 124 through opening 808 for launching paintball 114. Diagram 802, like diagram 400, includes a striker 110, a bolt 116, a valve 112, a triggering mechanism, and paintballs 114-115. In one aspect, striker 110 and valve 112 are physically situated above bolt 116 away from the ground as indicated by arrow 150.

Figure 6C:
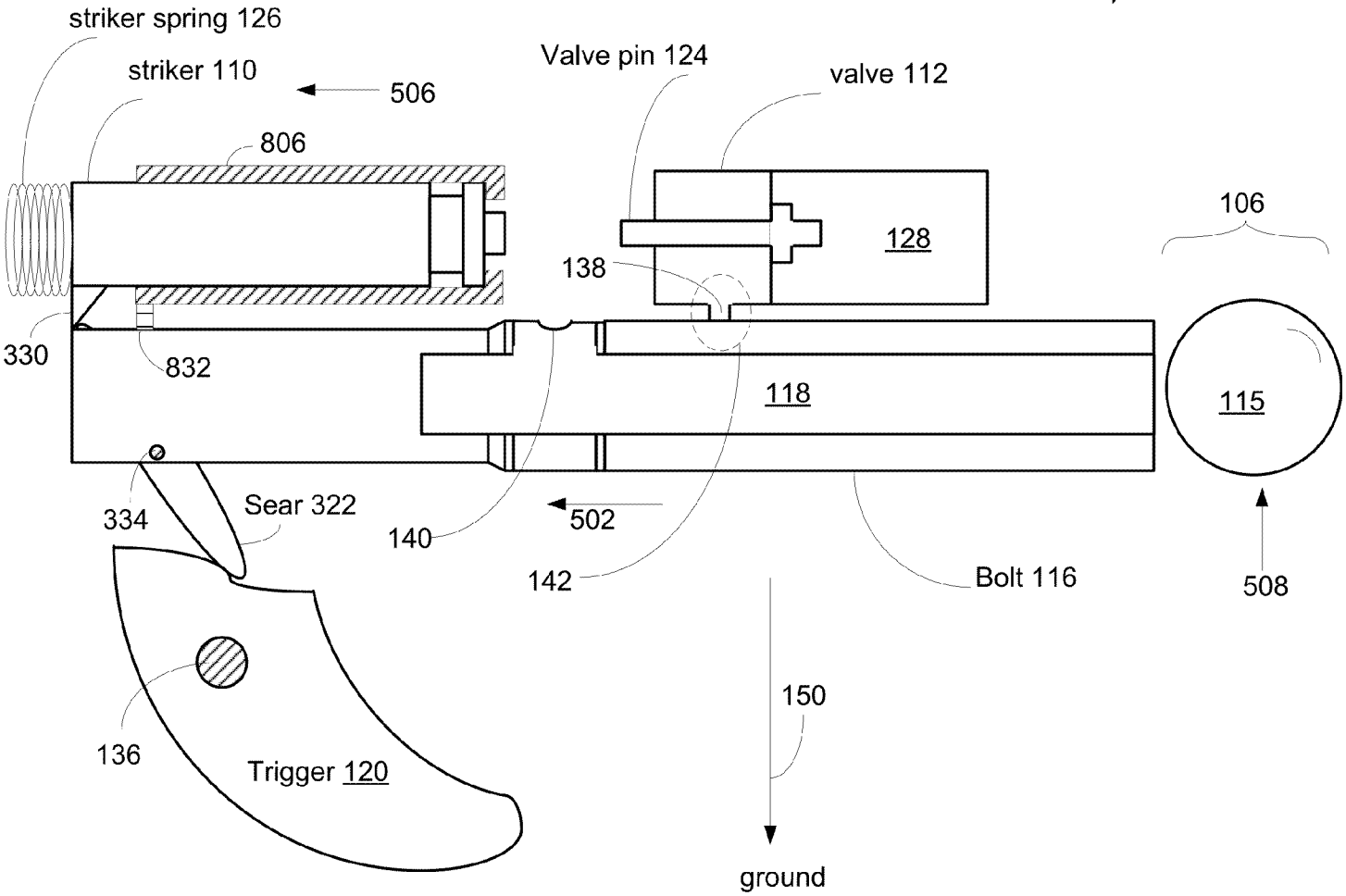

FIG. 6C is a block diagram 804 illustrating a cocking process wherein the striker is cocked immediately after a firing in accordance with one embodiment of the present invention. Diagram 804 is similar to diagram 802 shown in FIG. 6B except that diagram 802 illustrates the TSL mechanism in a firing scenario while diagram 804 illustrates the TSL mechanism in a cocking or recoiling scenario. Diagram 804 includes a piston 806, a striker 110, a bolt 116, a valve 112, a triggering mechanism, and paintballs 114-115.

The recoiling or cocking force generated during the projectile launching, bolt 116 moves in a direction indicated by arrow 502 which is an opposite direction as the travel direction of the launched projectile. As bolt 116 moves in a direction indicated by arrow 506, piston anchor 832 takes piston 806 which subsequently catches striker 110 to move in the same direction as bolt 116 as indicated by arrow 506. As bolt 116 moves, projectile 115 moves from a loading port of receiver or magazine into loading chamber 106 as indicated by arrow 508. It should be noted that when striker 110 is cocked and it stops moving, piston 806 begins to slide in a direction opposite to the moving direction indicated by arrow 506. The movement of piston 806, not shown in FIG. 6C, stops when it reaches to a ready for firing position as indicated in FIG. 6A.

Figure 7:
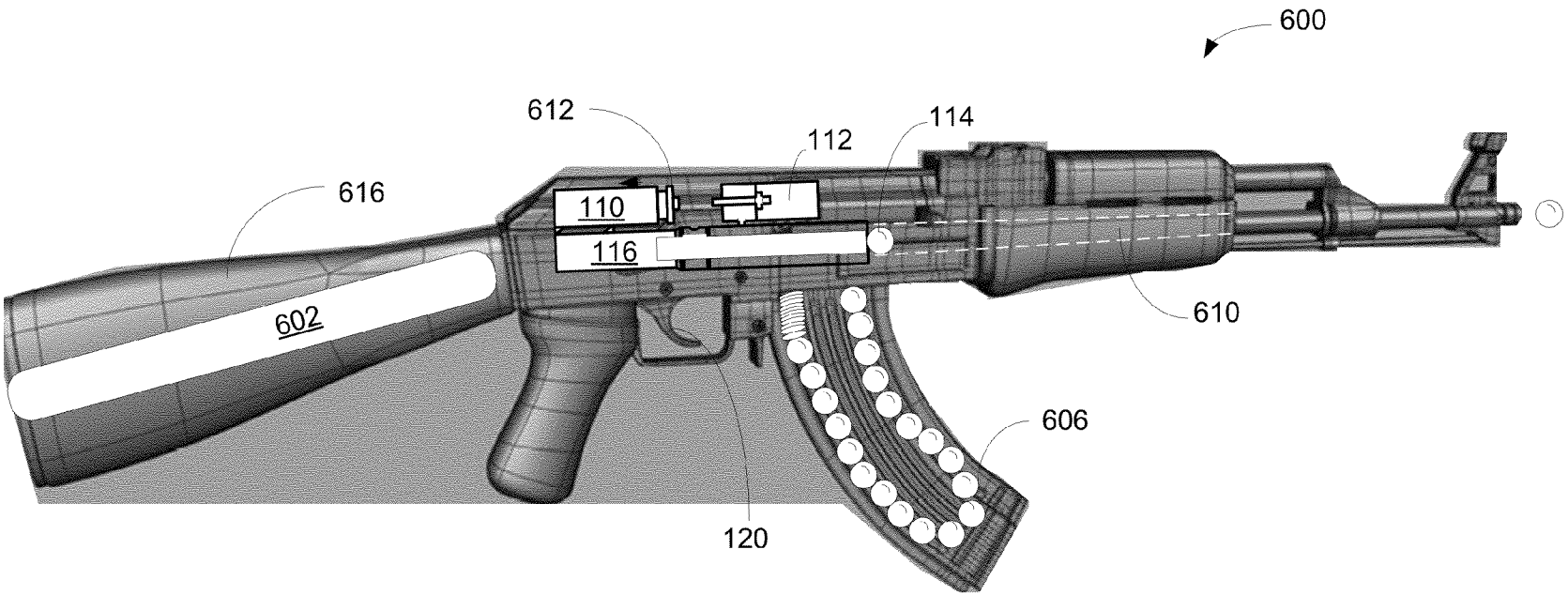
FIG. 7 is a diagram illustrating a projectile launcher using a TSL mechanism to launch a projectile in accordance with one embodiment of the present invention.

FIG. 7 is a diagram 600 illustrating a projectile launcher using a TSL mechanism to launch a projectile in accordance with one embodiment of the present invention. The launcher, in one aspect, includes a receiver 612, a magazine 606, a barrel assembly 610, a triggering mechanism, and a buttstock 616. Receiver 612 includes the TSL mechanism which includes top mounted striker 110 and valve 112, and bolt 116. It should be noted that the underlying concept of the exemplary embodiment(s) of the present invention would not change if one or more components (or units) were added to or removed from diagram 600.

Magazine 606 is removably attached or clipped to the bottom of receiver 612, and contains many rounds of ammunition or projectiles. In one embodiment, the projectiles are organized in one (1) column that the column of projectiles turns at the bottom of magazine 606. The triggering element or mechanism is also assembled at the bottom of receiver 612 and includes trigger 120. Buttstock 616 which is attached to the back side of receiver 612 further includes a pressurized gas source such as a gas canister 602. Barrel assembly 610 is situated in front of receiver 612 used for propelling projectiles. It should be noted that receiver 612, barrel assembly 610, and/or triggering mechanism may be fabricated in a single unit.

A projectile launcher or paintball marker, in one embodiment, includes receiver 612, a trigger 120, and a bottom mounted magazine 606. Receiver 612 includes a striker rail and a bolt rail, not shown in FIG. 6, wherein the bolt rail is situated below the striker rail. It should be noted that striker rail is similar to the striker chamber and bolt rail is similar to the bolt chamber. While the striker rail guides movement of the striker, the bolt rail guides movement of the bolt. Trigger 120 which is coupled to bottom part of receiver 612 is configured to allow a user to pull trigger 120 for launching a paintball 114. Bottom mounted magazine 606 contains projectiles such as paintballs and is able to couple to a loading port of receiver 612.

Receiver 612 further includes a bolt 116, a valve 112, and a striker 110. Bolt 116 has an air channel and a bolt carrier and is attached to the bolt rail. Bolt 116 is configured to propel paintball 114 from a firing chamber. Valve 112, situated inside receiver 612 located above the firing chamber away from ground, is operable to control pressurized gas for propelling the paintball. Striker 110, which may be optionally coupled to bolt 116 via the bolt carrier or datable bolt carrier, is coupled to the striker rail. Striker 110 is configured to strike a valve pin of valve 112 to release a predefined amount of pressurized gas for propelling the paintball. Buttstock 616 includes pressurized gas supply 602 which can be a gas tank.

Figure 8:
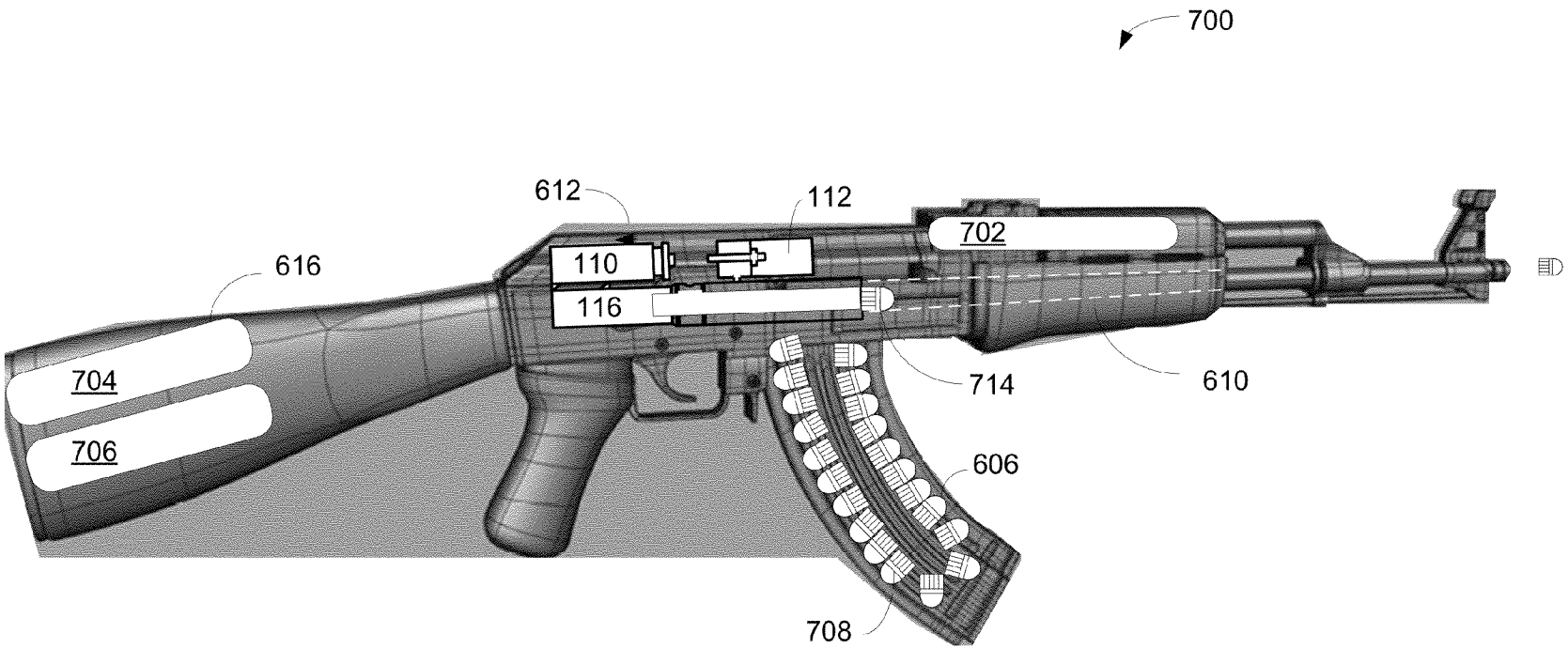
FIG. 8 is a diagram illustrating a projectile launcher using a TSL mechanism to propel projectiles with directional fins in accordance with one embodiment of the present invention.

FIG. 8 is a diagram 700 illustrating a projectile launcher using a TSL mechanism to propel projectiles with directional fins in accordance with one embodiment of the present invention. Diagram 700 is similar to diagram 600 shown in FIG. 7 except the projectile launcher shown in diagram 700 contains multiple gas sources 702-706 and is capable of launching directional projectiles 708 with fins. The launcher, in one aspect, includes a receiver 612, a magazine 606, a barrel assembly 610, a triggering mechanism, and a buttstock 616. Receiver 612 includes the TSL mechanism which includes top mounted striker 110 and valve 112, and bolt 116. It should be noted that the underlying concept of the exemplary embodiment(s) of the present invention would not change if one or more components (or units) were added to or removed from diagram 700.

Directional projectile or paintball 708 includes a capsule containing a cargo housing paint while the added fin around directional projectile is to enhance accuracy and distance for the projectile. To launch directional projectile or paintball, the orientation of directional projectile 708 is important when it leaves barrel assembly 610. In one embodiment, the orientation of directional projectile 708 is that the cargo portion of projectile is in front and the fin portion is situated behind the cargo portion whereby the fin, in one aspect, can assist a spinning motion of projectile whereby it enhances accuracy and travel distance.

An advantage of having multiple gas sources is that they can enhance the capability of launcher during operation. In addition, it indicates the number of full canisters as well as empty canisters.

Figure 9:
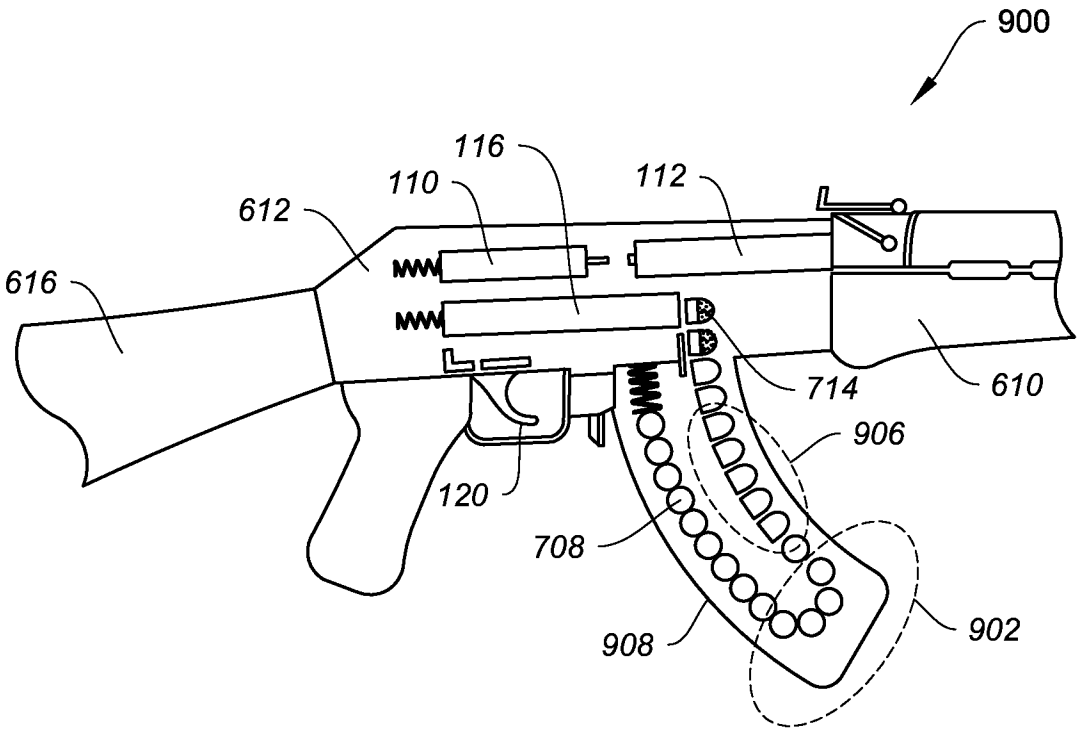
FIG. 9 is a diagram illustrating a projectile launcher using a TSL mechanism and a magazine capable of housing projectiles with directional fins in accordance with one embodiment of the present invention.

FIG. 9 is a diagram 900 illustrating a projectile launcher using a TSL mechanism and a magazine capable of housing projectiles with directional fins in accordance with one embodiment of the present invention. Diagram 900 is similar to diagram 700 shown in FIG. 8 except the projectile launcher shown in diagram 900 contains a magazine 908 which is capable of reorienting projectile to optimize projectile launching distance as well as accuracy. The launcher, in one aspect, includes a receiver 612, a magazine 606, a barrel assembly 610, a triggering mechanism, and a buttstock 616. Receiver 612 includes the TSL mechanism which includes top mounted striker 110 and valve 112, and bolt 116.

In one embodiment, magazine 908 includes a turning channel 902 and a reorienting channel 906 wherein turning channel 902 includes a one-hundred eighty degree ("180°") turning passageway allowing directional projectiles 708 to move around the bottom portion of magazine 908. Note that when projectiles 708 are loaded into magazine 908, projectiles 708 are oriented in a first direction so that they can move through turning channel 902 smoothly. After moving through turning channel 902, projectiles 708 are reoriented to prepare for launch when projectiles 708 pass through reorienting channel 906. For example, after moving through reorienting channel 906, projectiles 708 is oriented or positioned in a launch position ready to be fired. It should be noted that launching orientation of a directional projectile 708 is that the cargo portion of projectile is in front and the fin portion is situated behind the cargo portion whereby the fin, in one aspect, can assist a spinning motion of projectile whereby it enhances accuracy and travel distance.

While particular embodiments of the present invention have been shown and described, it will be obvious to those of ordinary skills in the art that based upon the teachings herein, changes and modifications may be made without departing from this exemplary embodiment(s) of the present invention and its broader aspects. Therefore, the appended claims are intended to encompass within their scope all such changes and modifications as are within the true spirit and scope of this exemplary embodiment(s) of the present invention.

What is claimed is:

1. A paintball launcher comprising:

a buttstock positioned at one end of the paintball launcher and configured to facilitate an upright position for the paintball launcher during an operation of the paintball launcher;

a bolt having an air channel and a bolt carrier, and configured to be situated inside a receiver, the bolt able to facilitate launch of a projectile;

a valve, situated inside the receiver above a firing chamber away from ground, operable to control release of pressurized gas for propelling the projectile;

a striker, coupled to the bolt via the bolt carrier and physically situated above the bolt away from the ground, configured to strike a valve pin of the valve to release a predefined amount of pressurized gas for propelling the projectile from the firing chamber to a target;

a bolt chamber for facilitating bolt movement placed at upper portion of the receiver; and a striker chamber for facilitating striker movement placed at lower portion of the receiver;

wherein the bolt carrier is configured to synchronize movements between the bolt and the striker.

2. The launcher of claim 1, further comprising a sear situated adjacent to the bolt and configured to control movement of the bolt in response to movement of a trigger.

3. The launcher of claim 1, further comprising an ammunition magazine containing a plurality of projectiles, wherein the ammunition magazine is able to couple to a loading port of the receiver for supplying ammunition, wherein the ammunition magazine is situated below the bolt closer to the ground.

4. The launcher of claim 1, wherein the projectile is a paintball.

5. The launcher of claim 1, further comprising a triggering mechanism attached to bottom portion of the receiver and configured to couple to the sear for triggering the bolt.

6. A paintball marker capable of launching a paintball comprising the projectile launcher of claim 1.

7. A paintball marker able to launch an object, comprising:

a buttstock positioned at one end of the paintball marker and configured to facilitate an upright position for the paintball marker during an operation of the paintball marker;

a bolt having an air channel and a bolt carrier, and configured to be situated inside a receiver, the bolt able to facilitate launch of a paintball;

a valve, situated inside the receiver above the bolt away from ground, operable to control release of pressurized gas for propelling the paintball;

a striker physically situated above the bolt away from the ground and configured to push a valve pin of the valve to propel the paintball from a firing chamber to a target;

a sear situated adjacent to the bolt and configured to control movement of the bolt in response to movement of a trigger; and wherein the receiver includes a bolt chamber situated underneath of a striker chamber, wherein the bolt chamber facilitates movement of the bolt and the striker chamber facilitates movement of the striker, wherein the movement of bolt and the movement of striker in the receiver are substantially synchronized by a bolt carrier.

8. The marker of claim 7, further comprising an ammunition magazine containing a plurality of paintballs.

9. The marker of claim 8, wherein the ammunition magazine is able to couple to a loading port of the receiver for supplying ammunition, wherein the ammunition magazine is situated below the bolt closer to the ground.

10. The marker of claim 7, further comprising a triggering mechanism attached to bottom portion of the receiver and configured to couple to the sear for triggering the bolt.

11. A paintball launcher comprising:

a buttstock positioned at one end of the paintball launcher and configured to facilitate an upright position for the paintball launcher during an operation of the paintball launcher;

a valve situated inside a receiver operable to release a predefined amount of pressurized gas for propelling an object to a target;

a striker situated adjacent to the valve and configured to strike a valve pin of the valve to release the pressurized gas for launching the object from a firing chamber; and a bolt, having an air channel and a bolt carrier, configured to be situated below the striker toward ground and coupled to the striker via the bolt carrier for facilitating launch of the object;

wherein the receiver includes a bolt chamber facilitating movement of the bolt and a striker chamber facilitating movement of the striker; wherein the bolt chamber is situated underneath of the striker chamber; and wherein the movement of bolt and the movement of striker in the receiver are substantially synchronized by the bolt carrier.

12. The launcher of claim 11, further comprising a sear situated adjacent to the bolt and configured to control movement of the bolt in response to movement of a trigger.

13. The launcher of claim 11, further comprising an ammunition magazine containing a plurality of projectiles, wherein the ammunition magazine is able to couple to a loading port of the receiver for supplying ammunition wherein the ammunition magazine is situated below the bolt closer to the ground.

* * * * *